US009073326B2

(12) United States Patent
Tosaka

(10) Patent No.: US 9,073,326 B2
(45) Date of Patent: Jul. 7, 2015

(54) INKJET PRINTING APPARATUS AND CONTROL METHOD THEREOF

(71) Applicant: CANON KABUSHIKI KAISHA, Tokyo (JP)

(72) Inventor: Yoichi Tosaka, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/338,388

(22) Filed: Jul. 23, 2014

(65) Prior Publication Data

US 2015/0042720 A1 Feb. 12, 2015

(30) Foreign Application Priority Data

Aug. 9, 2013 (JP) ..... 2013-166997

(51) Int. Cl.
*B41J 29/393* (2006.01)
*B41J 2/165* (2006.01)

(52) U.S. Cl.
CPC ..... *B41J 2/16538* (2013.01)

(58) Field of Classification Search
CPC .... B41J 2/16535; B41J 2/16544; B41J 2/165; B41J 29/393
See application file for complete search history.

(56) References Cited

U.S. PATENT DOCUMENTS 8,556,378 B2 * 10/2013 Hutchison ..... 347/33
8,870,343 B2 * 10/2014 Komatsu et al. ..... 347/33
8,926,060 B2 * 1/2015 Moscato et al. ..... 347/33

FOREIGN PATENT DOCUMENTS

JP 06-143597 A 5/1994

* cited by examiner

*Primary Examiner* — Lamson Nguyen
(74) *Attorney, Agent, or Firm* — Fitzpatrick, Cella, Harper & Scinto

(57) ABSTRACT

An inkjet printing apparatus comprises a cleaning unit configured to perform a cleaning operation of moving at least one of a printhead and a wiper, and wiping an orifice face including an orifice array of the printhead by the wiper; a detection unit configured to detect relative positions of the printhead and the wiper during the cleaning operation; and a control unit configured to switch between first control of controlling a speed to be constant when the printhead and the wiper are moved, and second control of controlling a driving force to be constant when the printhead and the wiper are moved in accordance with the relative positions detected by the detection unit.

14 Claims, 7 Drawing Sheets

INKJET PRINTING APPARATUS AND CONTROL METHOD THEREOF

BACKGROUND OF THE INVENTION

1. Field of the Invention

The present invention relates to a technique of cleaning the nozzle surface of the printhead of an inkjet printing apparatus.

2. Description of the Related Art

An inkjet printing apparatus includes a head cleaning means for removing ink and dust adhered to the nozzle surface (face) of a printhead from which ink is discharged. The head cleaning means scrapes off ink and dust by pressing, against the face, a wiper made of an elastic material such as rubber, and wiping the face (see Japanese Patent Laid-Open No. 06-143597).

To implement desired cleaning performance, high accuracy is requested for wiper driving. For example, to completely remove ink and dust by one wiping, the wiper is desirably moved at a constant speed regardless of the driving load. Positions at which the wiper starts and ends contact to the face also need to be accurate so as not to generate acceleration/deceleration in a region where the wiper should be controlled at a constant speed. To achieve this, many inkjet printing apparatuses adopt a method of servo-controlling a DC motor.

When the wiper is driven by servo-controlling the DC motor, as described above, cleaning can be performed at a constant speed with respect to the driving load which fluctuates depending on the contact state to the face. However, wiper position information needs to be obtained by another means.

As a method of obtaining the wiper position information, there is a method in which a limit switch or optical sensor for detecting a wiper position is arranged, and the current position is calculated from motor rotation position information obtained from an encoder by using a detection position as the start point. As another method, a stopper is arranged at the end of a range in which the wiper moves in the cleaning operation, and when no motor rotation information is obtained from the encoder, it is determined that the wiper is positioned at the end.

Of these two methods described above, the latter method is more desirable because it does not require the cost of a sensor or the like. However, when the wiper and stopper abut against each other, an excessive force may be added, and the wiper driving mechanism and stopper require a structure resistant to the excessive force. Further, when the wiper abuts against the stopper, a flexure readily occurs, and the stop position may become unstable owing to the repulsion.

A cleaning operation in a related art will be explained with reference to FIGS. 7A to 7C and 8.

FIGS. 7A to 7C are views showing the main part of an inkjet printing apparatus in the related art, including a printhead 3 and recovery unit 5, when viewed from the side. FIG. 7A shows a standby state before cleaning, FIG. 7B shows a state during cleaning, and FIG. 7C shows a state in which cleaning has ended. FIG. 8 shows a change of the driving force during the cleaning operation in the related art.

When the cleaning operation starts in a section A in FIG. 8, wipers 7 and 8 are controlled to move at a constant speed, and contact a face 3*a*. In a section B, the wipers 7 and 8 wipe the face 3*a* at a constant speed. The driving load in the section B fluctuates depending on the state of the face 3*a*. For example, when a large amount of ink is adhered to the face 3*a* and the ink is dried, the friction coefficient and driving load increase. To maintain a constant speed, the driving force is controlled to be large, as indicated by (v). In a state in which the amount of adherent ink is small and the moisture content is high, the driving load decreases, and thus the driving force is also controlled to be small, as indicated by (vi).

When the wipers 7 and 8 pass the face 3*a*, the driving load temporarily decreases, as represented in a section C, and the wipers 7 and 8 abut against a stopper (not shown) and cannot move any more. In a section D, the driving force increases and reaches a predetermined upper limit value. At this time, even if the driving force is increased to the predetermined upper limit value, the wipers 7 and 8 do not move, and the motor does not rotate. From this, it is determined that the wipers have abutted against the stopper, and the energization stops.

The predetermined upper limit value is set to be larger than the load during cleaning in order to prevent the stop of the wipers 7 and 8 during cleaning owing to an insufficient driving force by setting a larger upper limit value than a maximum load on the premise of generation of the maximum load in the section B. However, every time the wipers 7 and 8 abut against the stopper, the stopper receives a shock caused by driving the wipers 7 and 8 by a driving force equivalent to the upper limit value. Therefore, the wiper driving mechanism and stopper require a structure resistant to an excessive force. Also, when the wipers abut against the stopper, a flexure readily occurs, and the stop position may become unstable owing to the repulsion.

SUMMARY OF THE INVENTION

The present invention has been made in consideration of the aforementioned problems, and realizes an inkjet printing apparatus capable of reducing a shock in a cleaning operation, and shortening the cleaning time while maintaining the cleaning performance.

In order to solve the aforementioned problems, the present invention provides an inkjet printing apparatus comprising: a cleaning unit configured to perform a cleaning operation of moving at least one of a printhead and a wiper, and wiping an orifice face including an orifice array of the printhead by the wiper; a detection unit configured to detect relative positions of the printhead and the wiper during the cleaning operation; and a control unit configured to switch between first control of controlling a speed to be constant when the printhead and the wiper are moved and second control of controlling a driving force to be constant when the printhead and the wiper are moved in accordance with the relative positions detected by the detection unit.

In order to solve the aforementioned problems, the present invention provides a control method of an inkjet printing apparatus having a printhead having an orifice face including an orifice array, and a wiper configured to wipe the orifice face, the method comprising: a step of performing a cleaning operation of moving at least one of the printhead and the wiper, and wiping the orifice face by the wiper; a step of detecting relative positions of the printhead and the wiper during the cleaning operation; and a step of switching between first control of controlling a speed to be constant when the printhead and the wiper are moved, and second control of controlling a driving force to be constant when the printhead and the wiper are moved in accordance with the detected relative positions.

According to the present invention, a shock in a cleaning operation can be reduced, and the cleaning time can be shortened while maintaining the cleaning performance.

Further features of the present invention will become apparent from the following description of exemplary embodiments (with reference to the attached drawings).

DESCRIPTION OF THE EMBODIMENTS

Embodiments of the present invention will now be described in detail with reference to the accompanying drawings.

In this specification, the term "printing" (to be also referred to as "print") not only includes the formation of significant information such as characters and graphics, but also broadly includes the formation of images, figures, patterns, and the like on a printing medium, or the processing of the medium, regardless of whether they are significant or insignificant and whether they are so visualized as to be visually perceivable by humans.

Also, the term "printing medium" not only includes paper used in common printing apparatuses, but also broadly includes materials, such as cloth, a plastic film, a metal plate, glass, ceramics, wood, and leather, capable of accepting ink.

Furthermore, the term "ink" should be extensively interpreted similarly to the definition of "printing (print)" described above. That is, "ink" includes a liquid which, when applied onto a printing medium, can form images, figures, patterns, and the like, can process the printing medium, or can process ink (for example, solidify or insolubilize a coloring agent contained in ink applied to the printing medium).

Further, the term "printing element" (to be also referred to as a "nozzle") generically means an ink orifice or a fluid channel communicating with it, and an element which generates energy used to discharge ink, unless otherwise specified.

<Apparatus Arrangement> An inkjet printing apparatus including a head cleaning mechanism according to an embodiment of the present invention will be explained with reference to FIGS. 1 and 2.

Figure 1:
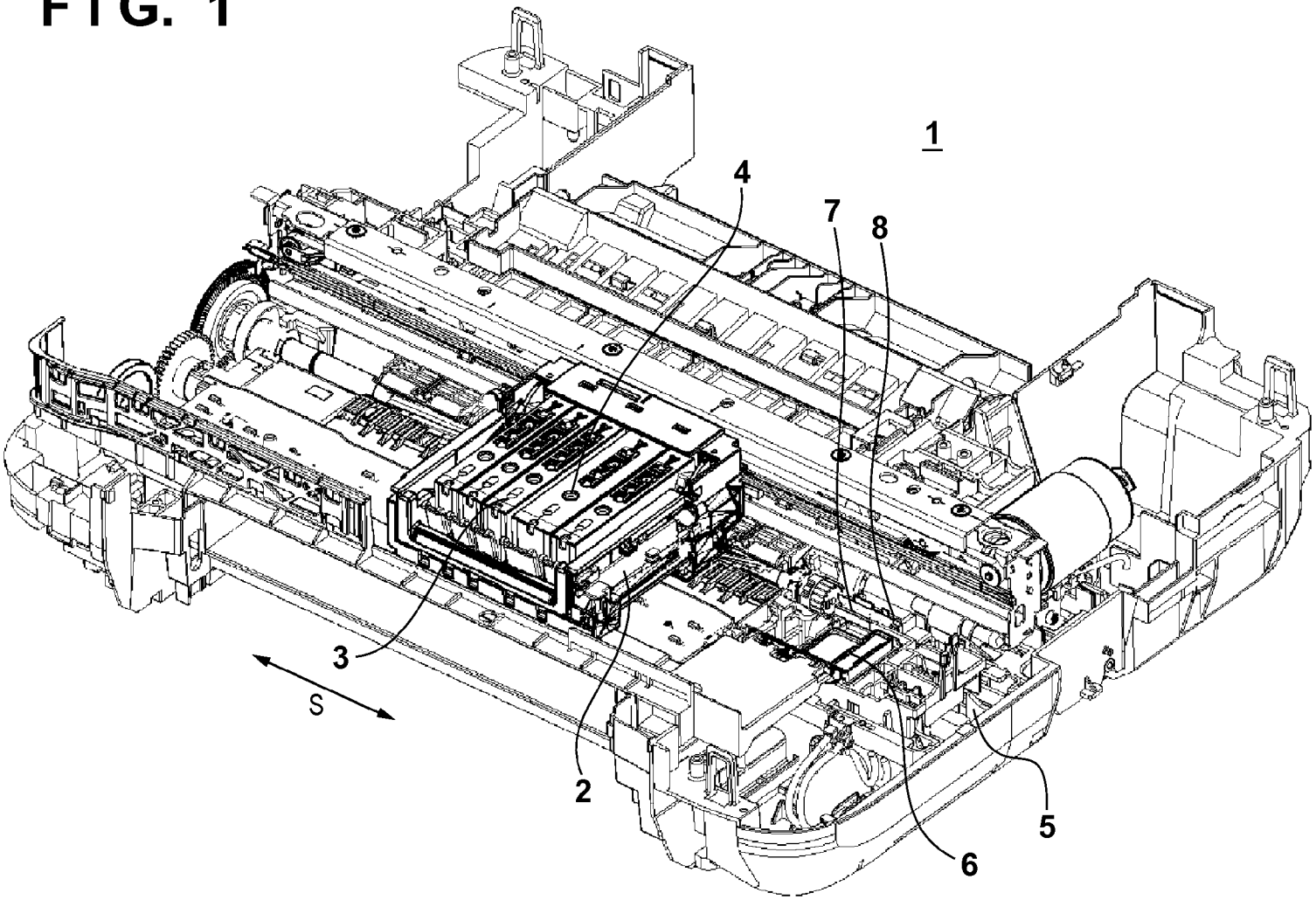
FIG. 1 is a perspective view showing an inkjet printing apparatus according to an embodiment.

In the inkjet printing apparatus, as shown in FIG. 1, an inkjet printhead (to be referred to as a printhead hereinafter) 3 which prints by discharging ink according to an inkjet method is mounted on a carriage 2. The carriage 2 reciprocates in directions indicated by an arrow S to print. Although not shown, a printing medium such as printing paper is fed via a paper feed mechanism, and conveyed to a printing position. At the printing position, the printhead 3 discharges ink to the printing medium to print.

On the carriage 2 of an inkjet printing apparatus 1, an ink cartridge 4 which stores ink to be supplied to the printhead 3 is also mounted in addition to the printhead 3. The ink cartridge 4 is detachable from the carriage 2.

The inkjet printing apparatus 1 shown in FIG. 1 is capable of color printing. For this purpose, four ink cartridges which store magenta (M), cyan (C), yellow (Y), and black (K) inks, respectively, are mounted on the carriage 2. These four ink cartridges are independently detachable.

The printhead 3 according to the embodiment employs an inkjet method of discharging ink by using thermal energy. The printhead 3 therefore includes electrothermal transducers. The electrothermal transducers are arranged in correspondence with respective orifices. A pulse voltage is applied to a corresponding electrothermal transducer in accordance with a printing signal, discharging ink from a corresponding orifice.

The inkjet printing apparatus 1 according to the embodiment includes a recovery unit 5 which maintains the printhead 3 by a head cleaning operation (to be described later).

The recovery unit 5 includes a cap 6, and wipers 7 and 8. The cap 6 can contact and retract from a face including the nozzle array of the printhead 3 which has moved immediately above. At the time of contact, the cap 6 can prevent drying of the face, and also suck and discharge, from the nozzle, ink including a bubble staying in an ink channel in the printhead. The wipers 7 and 8 are constituted by a pair of thin plates made of an elastic material such as rubber. The wipers 7 and 8 sequentially contact and wipe the face, removing an unwanted adherent matter such as dust or ink adhered to the nozzle surface.

Figure 2:
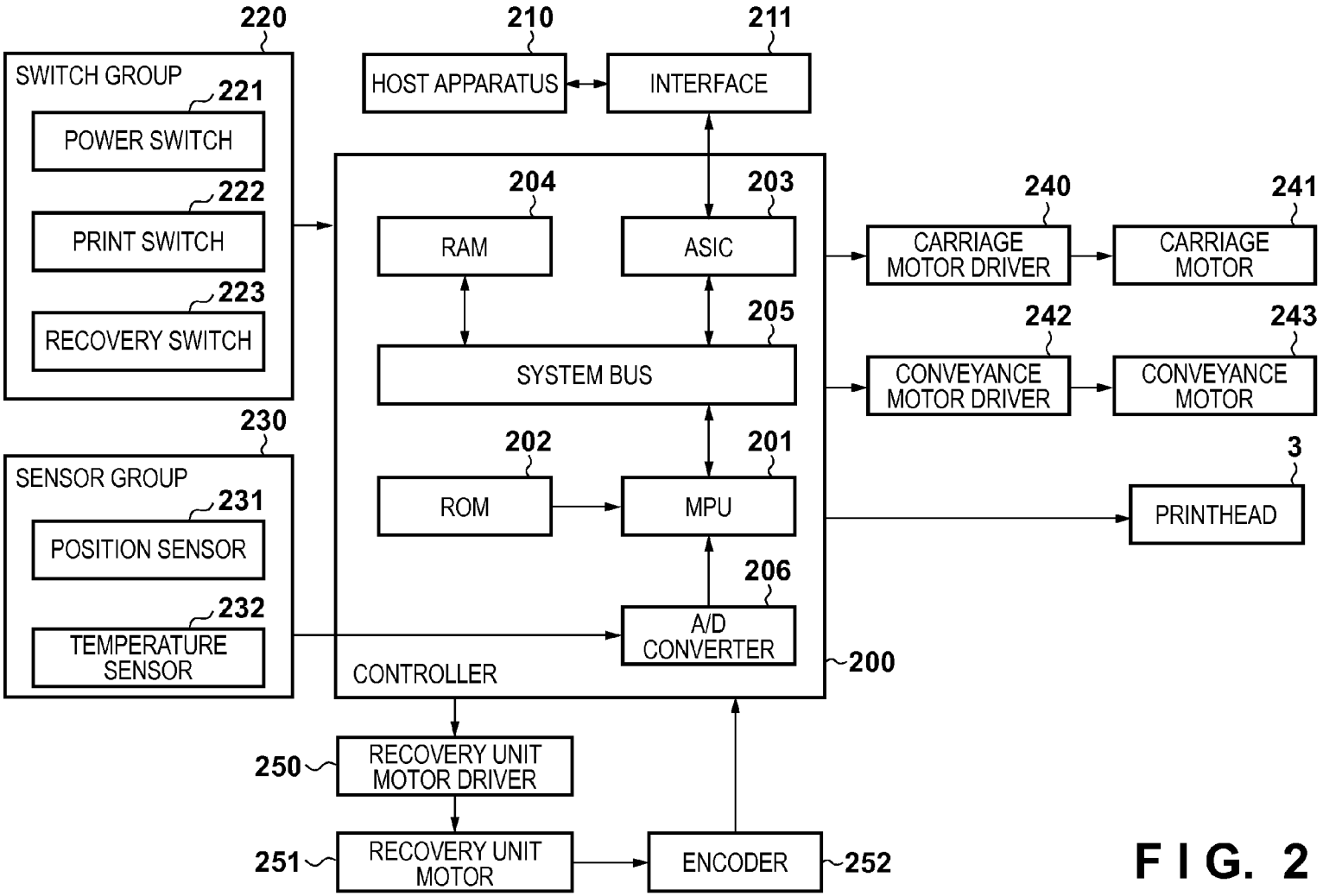
FIG. 2 is a block diagram showing the control system of the inkjet printing apparatus according to the embodiment.

FIG. 2 shows the arrangement of the control system of the inkjet printing apparatus according to the embodiment.

As shown in FIG. 2, a controller 200 includes an MPU 201, ROM 202, application specific integrated circuit (ASIC) 203, RAM 204, system bus 205, and A/D converter 206. The ROM 202 stores a program and control parameters for a printing operation, a program and control parameters for a cleaning operation (to be described later), necessary tables, and other data. The ASIC 203 generates control signals to control a carriage motor 241, a conveyance motor 243, the printhead 3, and the recovery unit 5. The RAM 204 is used as an image data rasterization area and a work area for program execution. The system bus 205 connects the MPU 201, ASIC 203, and RAM 204 to each other to exchange data. The A/D converter 206 receives an analog signal from a sensor group (to be explained below), A/D-converts it, and supplies the digital signal to the MPU 201.

Referring to FIG. 2, a computer 210 (or a reader for image reading or a digital camera) serves as an image data supply source and is generally called a host apparatus. The host apparatus 210 transmits/receives image data, commands, status signals, and the like to/from the inkjet printing apparatus 1 via an interface (I/F) 211. The image data is input in, for example, the raster format.

A switch group 220 includes a power switch 221, print switch 222, and recovery switch 223.

A sensor group 230 detects an apparatus state, and includes a position sensor 231 and temperature sensor 232.

A carriage motor driver 240 drives the carriage motor 241 to reciprocally scan the carriage 2 in the directions indicated by the arrow S. A conveyance motor driver 242 drives the conveyance motor 243 to convey a printing medium.

At the time of print scanning by the printhead 3, the ASIC 203 transfers, to the printhead, data for driving printing elements (discharge heaters) while directly accessing the storage area of the RAM 204.

A recovery unit motor driver 250 drives a recovery unit motor 251 which drives the wipers 7 and 8 of the recovery unit 5. The recovery unit motor 251 is a DC motor, and drives the wipers 7 and 8 of the inkjet printing apparatus 1 via a driving force transmission unit such as a gear train or clutch mechanism. An encoder 252 detects the rotation position of the recovery unit motor 251.

The MPU 201 calculates the current position from motor rotation position information detected by the encoder 252, and outputs a control instruction to the recovery unit motor driver 250. The recovery unit motor driver 250 controls the number of revolutions (rotational speed) and the torque (driving force) by changing a current value and PWM value to be supplied to the recovery unit motor 251, as needed, in accordance with a control instruction from the MPU 201.

<Head Cleaning Operation> Next, the arrangement and operation of the head cleaning mechanism of the inkjet printing apparatus according to the first embodiment will be described with reference to FIGS. 3A to 3D and 4.

FIGS. 3A to 3D are views showing the main part of the inkjet printing apparatus in FIG. 1, including the printhead 3 and recovery unit 5, when viewed from the side.

In FIGS. 3A to 3D, a wiper holder 10 which holds the wipers 7 and 8 is fixed to a base 9 of the recovery unit 5. A cap holder 11 which holds the cap 6 is held to be operable in directions in which the cap holder 11 comes into contact with and moves apart from the printhead 3. A rack gear 12 is engaged with a driving gear 13 fixed to the output shaft of the recovery unit motor 251, and one end of the rack gear 12 is coupled to the base 9. The base 9 is guided by a housing (FIG. 1), and can reciprocate left and right in FIGS. 3A to 3D together with the rack gear 12. A wiper cleaner 14 held by the housing (FIG. 1) has a function of scraping off ink or the like adhered to the wipers when the wipers 7 and 8 contact the wiper cleaner 14. A stopper 15 arranged in the housing (FIG. 1) has a function of abutting against the recovery unit 5 at the end position of the cleaning operation of the recovery unit 5, and restricting further movement.

Next, a head cleaning (to be referred to as cleaning hereinafter) operation according to the first embodiment will be explained.

FIGS. 3A to 3D show an operation of cleaning a face 3*a* of the printhead 3 by the wipers 7 and 8. FIG. 4 shows a change of the driving force of the recovery unit motor 251 during the cleaning operation. The ordinate represents the driving force of the recovery unit motor 251, and the abscissa represents the elapsed time of the cleaning operation.

The MPU 201 loads parameters which are stored in the ROM 202 and concern control of the moving speed and driving force of the wipers for the cleaning operation (sections A to D). The MPU 201 executes cleaning by controlling a speed and driving force in each section in accordance with the parameters.

Figure 3A:
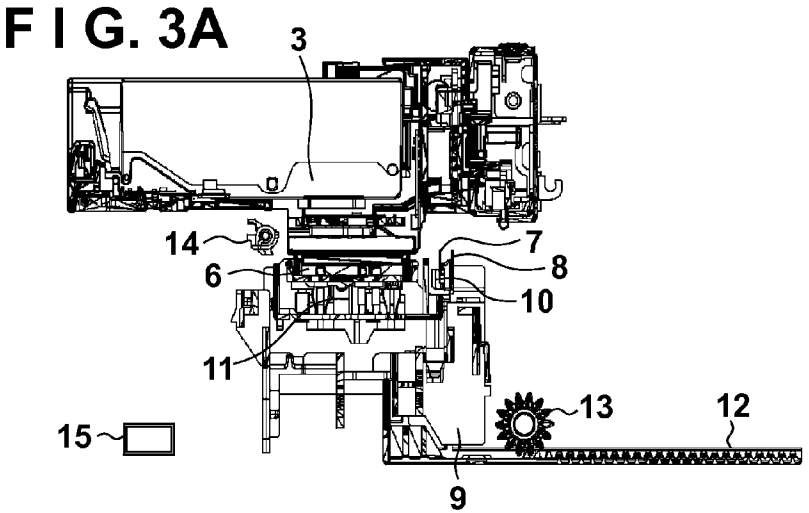
FIGS. 3A to 3D are views for explaining an outline of a head cleaning operation according to the first embodiment.
Figure 4:
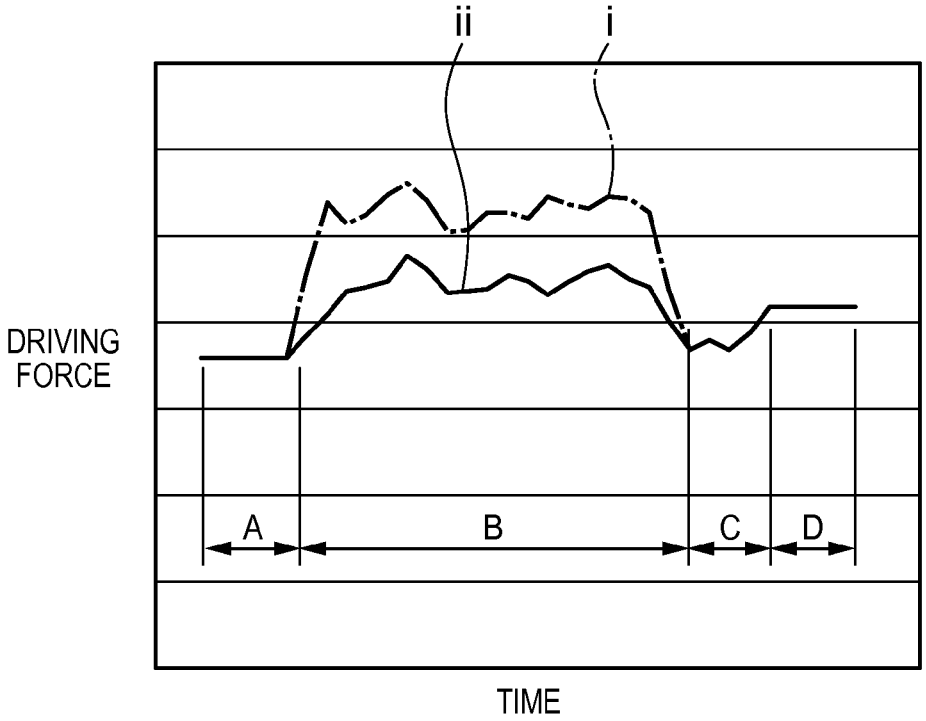
FIG. 4 is a graph showing a change of the driving force during the head cleaning operation according to the first embodiment.

FIG. 3A shows a standby state in which the printhead 3 does not print, and a state in which the cap 6 is pressed against the face 3*a* of the printhead 3. The printhead 3 is moved from the state in FIG. 1 to immediately above the recovery unit 5, and the cap 6 is moved up, thereby shifting to the standby state.

Figure 3B:
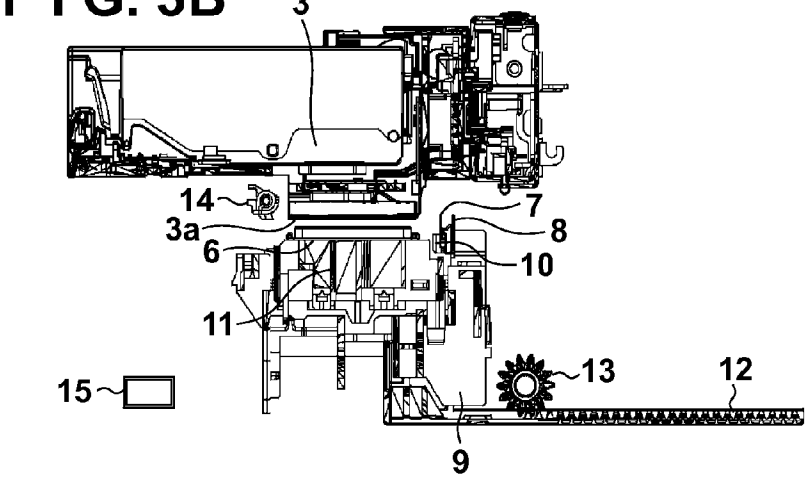
Figure 3C:
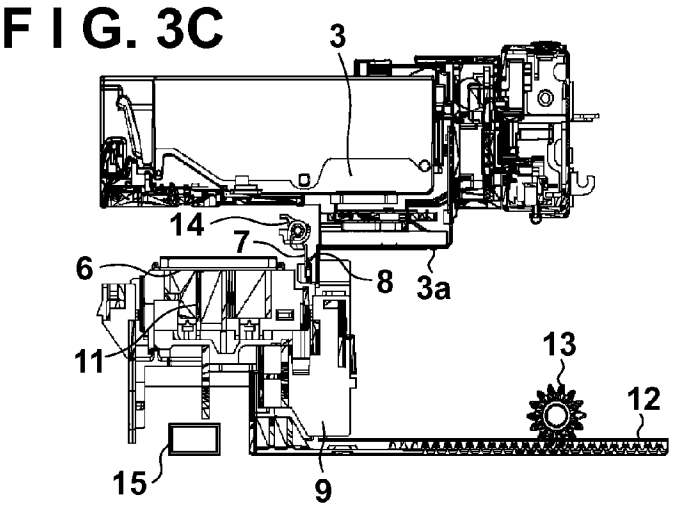

When starting the cleaning operation from the standby state in FIG. 3A, first, the cap 6 moves to a start position spaced apart from the printhead 3, as shown in FIG. 3B. Then, the MPU 201 controls the recovery unit motor 251 to drive the driving gear 13 to rotate clockwise, and the recovery unit 5 moves left in FIG. 3C via the rack gear 12, as shown in FIG. 3C. Meanwhile, the MPU 201 issues a control instruction to the recovery unit motor driver 250 while monitoring a detection signal from the encoder 252. The recovery unit motor driver 250 supplies, to the recovery unit motor 251, a current value and PWM value corresponding to the control instruction from the MPU 201. In this manner, the wipers 7 and 8 are controlled to move at a constant speed in the sections A to C of FIG. 4. In other words, the MPU 201 performs feedback control (constant-speed control) to change the current value and PWM value, as needed, so that the motor driving force is increased if the driving load of the wipers 7 and 8 is large, and decreased if the load is small.

The section A in FIG. 4 represents a driving force in constant-speed control. Since the wipers 7 and 8 have not contacted the face 3*a* of the printhead 3 yet, the load hardly fluctuates, and the driving force is almost constant.

In the next section B, the upper ends of the wipers 7 and 8 sequentially contact the face 3*a* of the printhead 3, and wipe the face 3*a* while keeping the contact. The driving load caused by wiping greatly fluctuates depending on the head state such as the adherent situation of ink and dust to the face 3*a*, or the drying situation, as described above. While the wipers 7 and 8 wipe the face 3*a* of the printhead 3, as in the section B of FIG. 4, the driving load fluctuates depending on the head state, and the driving force becomes large in case (i) or fluctuates in case (ii). However, the speed of the wipers 7 and 8 remains almost constant from the section A.

FIG. 3C shows a state in which the wiping of the face 3*a* of the printhead 3 by the wipers 7 and 8 has ended, that is, a state in which the wipers 7 and 8 have reached a position corresponding to the end of the section B in FIG. 4. Since there is no driving load by wiping of the wipers 7 and 8, the driving force also becomes almost equal to that in the section A.

In the next section C, the wipers 7 and 8 move further left from the state of FIG. 3C, and contact the wiper cleaner 14. The wiper cleaner 14 sequentially contacts the distal ends of the wipers 7 and 8, and scrapes off an unwanted adherent matter such as dust or ink adhered to the wipers 7 and 8. Only while the wipers 7 and 8 contact the wiper cleaner 14, the driving load in the section C becomes larger than that in the section A. However, for example, the wipers 7 and 8 contact the wiper cleaner 14 one by one, so the driving load is much smaller than that during cleaning during which the wipers 7 and 8 wipe the face 3*a*, and is not so different from the driving load in the section A.

In shift to the next section D, the motor control method is switched from constant-speed control to constant-driving force control in which the driving force is controlled to be constant. In constant-driving force control, the MPU 201 drives the recovery unit motor 251 in accordance with a current value and PWM value corresponding to constant-driving force control parameters stored in the ROM 202. In constant-driving force control, even if the driving load fluctuates, a driving force generated in the recovery unit motor 251 does not change, and the driving load in the section D is almost equal to that in the section A. To increase the speed in the section D, it is only necessary to set a larger driving force than that in the section A.

Figure 3D:
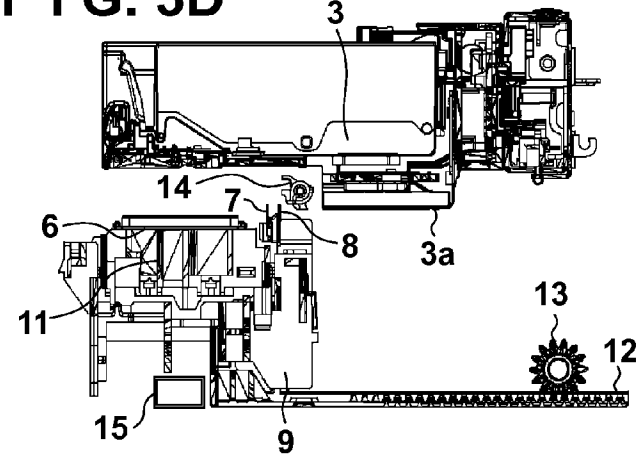

FIG. 3D shows a state in which the base 9 contacts the stopper 15 and the movement is restricted, and shows a state in which the base 9 reaches a position corresponding to the end of the section D in FIG. 4. In the section D, constant-driving force control is performed. Thus, even if the recovery unit 5 does not move any more, the driving force does not increase, and no excessive force is added to the driving mechanism and recovery unit 5.

To reliably about the recovery unit 5 against the stopper 15, it suffices to stop driving of the recovery unit motor 251 when it is determined during monitoring by the encoder 252 that the recovery unit 5 does not move any more. Alternatively, constant-driving force control may be simply performed for a predetermined time during which abutment can be satisfactorily guaranteed. Even in this case, constant-driving force control is similarly performed to prevent addition of an excessive force. When an excessive load is added owing to a trouble or the like, and the wipers 7 and 8 do not move to the stopper 15, it is determined that this is an error state, and a recovery operation and error display are performed.

After the recovery unit 5 abuts against the stopper 15, the printhead 3 is retracted from above the recovery unit 5, and the recovery unit motor 251 rotates the driving gear 13 counterclockwise (left). In response to this, the recovery unit 5 moves right in FIGS. 3A to 3D via the rack gear 12 and returns to the position shown in FIG. 3B, ending the cleaning. At this time, a stopper may be arranged at a position where the recovery unit 5 returns to the state in FIG. 3B so that the recovery unit 5 abuts against the stopper in constant-driving force control, similarly to the end of cleaning. In this fashion, the effect of preventing generation of an unnecessary driving force upon abutment is obtained even in the return operation from the cleaning end position.

According to the above-described embodiment, while the wipers wipe the face (sections A to C), constant-speed control is performed, and after the wipers end the wiping of the face (section D), is switched to constant-driving force control. By this control, while the wipers wipe the face (sections A to C), they can be moved at a constant speed to maintain the cleaning performance. After the wipers end the wiping of the face (section D), addition of an excessive force when an unnecessary driving force is applied and the wipers abut against the stopper can be prevented. By setting a larger driving force than those in the sections A to C, the speed can be increased to shorten the cleaning time.

In the embodiment, constant-speed control is switched to constant-driving force control when the wipers 7 and 8 pass the wiper cleaner 14, but it may be switched when the wipers 7 and 8 pass the face 3*a*. In this case, the load of the wiper cleaner 14 needs to be considered in the setting of the driving force in constant-driving force control. However, the load of the wiper cleaner 14 is smaller than that caused by wiping of the face 3*a*, as described above, or can be reduced. Thus, a set driving force takes a value enough to suppress a shock caused by an excessive force.

Second Embodiment

Figure 5:
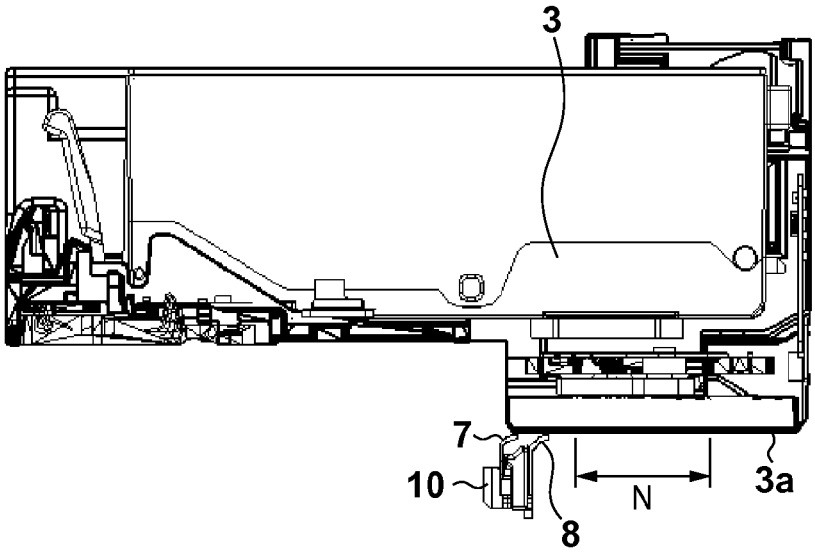
FIG. 5 is a view for explaining an outline of a head cleaning operation according to the second embodiment.

The second embodiment in which two or more driving forces are set in constant-driving force control will be described with reference to FIGS. 5 and 6. In the first embodiment, one driving force is set in constant-driving force control (section D). In the second embodiment, two or more driving forces are set.

In the second embodiment, the same reference numerals as those in the first embodiment denote the same parts, and a description thereof will not be repeated. FIG. 5 shows a state during cleaning of a face 3*a* by wipers 7 and 8. In FIG. 5, N represents a range in which nozzles for discharging ink exist in the face 3*a*. In the state of FIG. 5, both the wipers 7 and 8 have passed the nozzle range N.

Next, a cleaning operation in the second embodiment will be explained.

Figure 6:
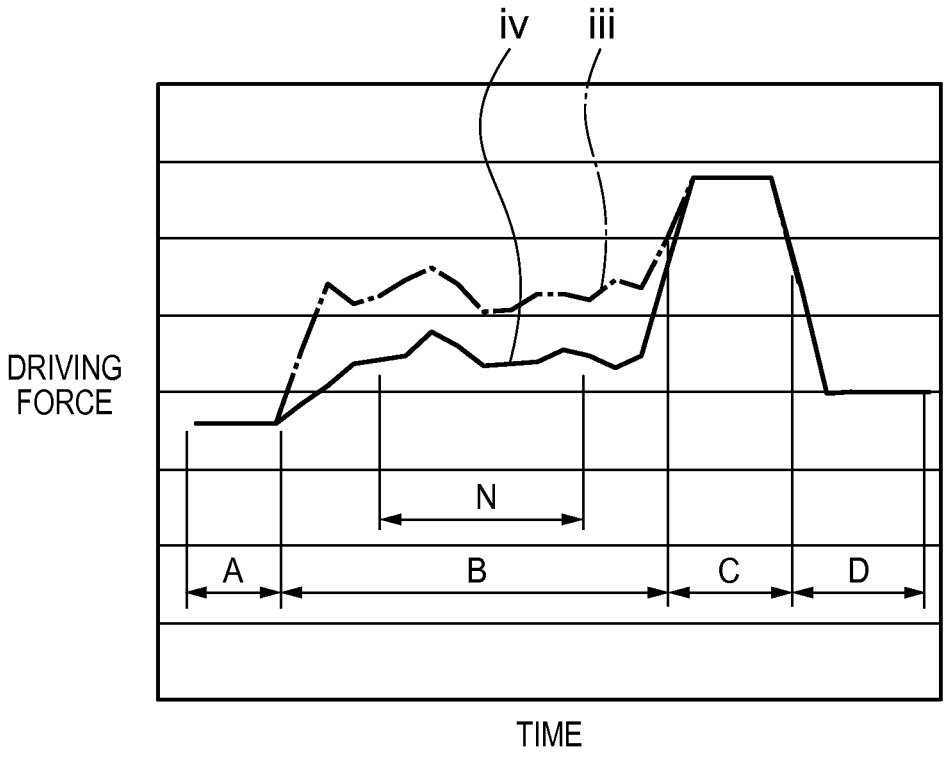
FIG. 6 is a graph showing a change of the driving force during the head cleaning operation according to the second embodiment.
Figure 7A:
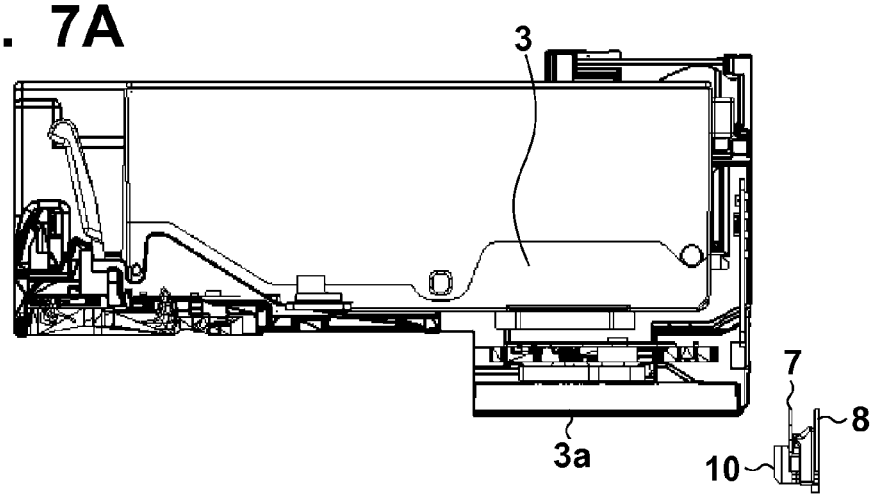
FIGS. 7A to 7C are views for explaining an outline of a cleaning operation in a related art.
Figure 7B:
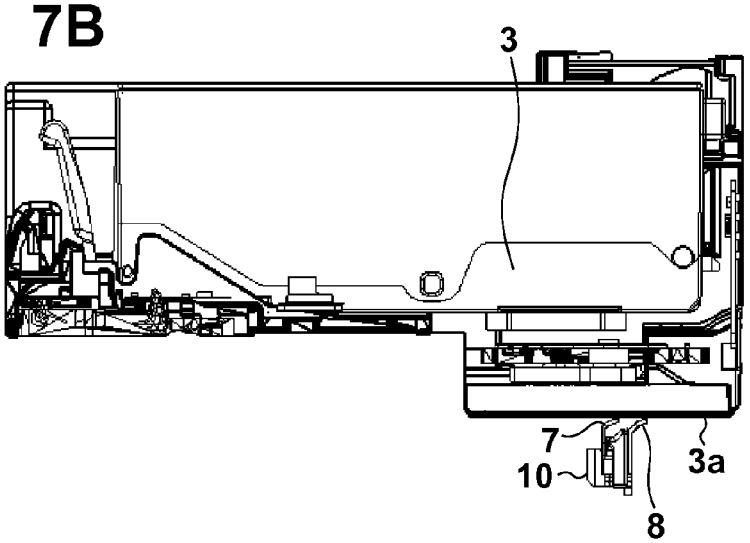
Figure 7C:
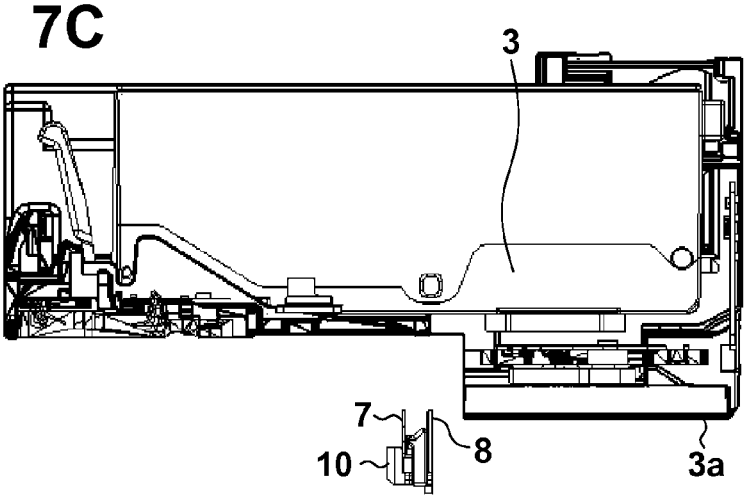
Figure 8:
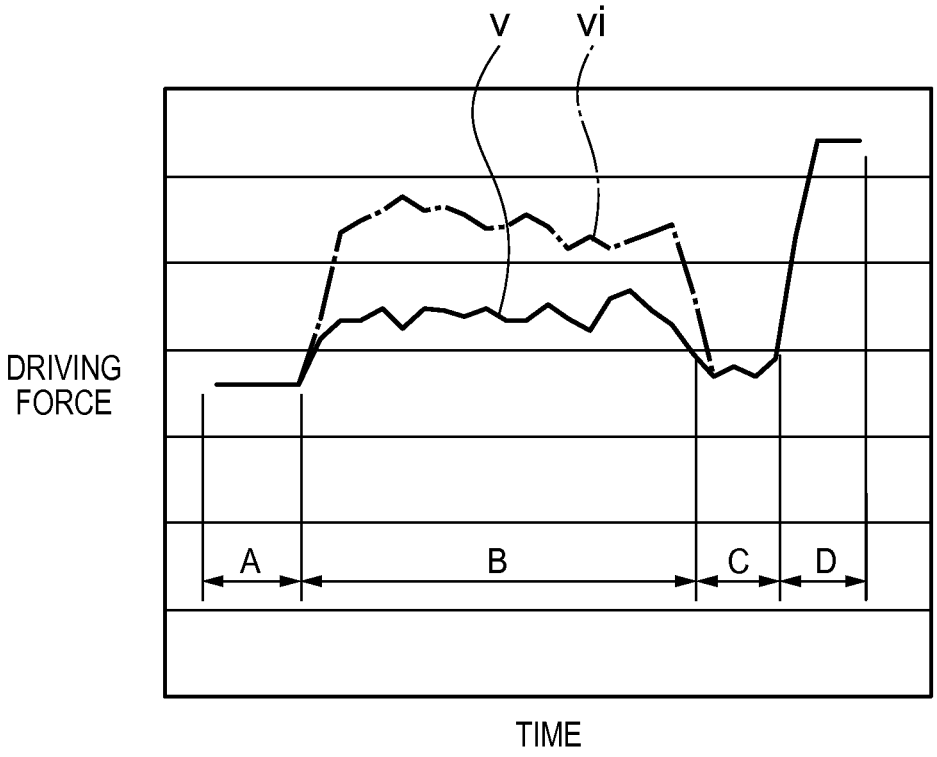
FIG. 8 is a graph showing a change of the driving force during the cleaning operation in the related art.

In the section B of FIG. 6, constant-speed control is performed until the wipers 7 and 8 pass the nozzle range N of the face 3*a*. A gear train constituting a driving mechanism generally has a backrush. Thus, a delay is generated at this time not to transfer the driving force to a recovery unit 5 until the backrush is canceled after the start of driving. A maximum delay amount can be calculated based on the gear train arrangement. Considering this, the section B is set to continue control until the wipers 7 and 8 pass the nozzle range N even when the maximum delay is generated. Since the wipers 7 and 8 still contact the face 3*a* till the end of the section B, as shown in FIG. 5, the driving load is large, and the driving force varies greatly. To maintain a constant speed, the driving force is controlled to be large as in (iii) when the driving load is large, and small as in (iv) when the driving load is small.

In the next section C, constant-speed control is switched to constant-driving force control. A driving force set in constant-driving force control in the section C is set to be a larger value than the maximum load generated when the wipers 7 and 8 wipe the face 3*a*. The section C continues until the wipers 7 and 8 pass the face 3*a* even when the maximum delay is generated. Even in the next section D, constant-driving force control continues. However, the wipers 7 and 8 do not wipe the face 3*a* any more, and the driving load becomes smaller than that in the section C and is stabilized. Hence, the setting of the driving force is changed to a corresponding value. The stopper 15 is set at a position spaced apart from one corresponding to the end position of the section C at which the maximum delay amount is generated, so that the recovery unit 5 abuts against the stopper 15 in the section D.

According to the above-described second embodiment, constant-speed control is performed until the wipers pass the nozzle range of the face (sections A and B) after the start of cleaning, and is switched to constant-driving force control. Constant-driving force control continues until the wipers pass the face (section C). A driving force set in the section C is set to be a larger value than the maximum load generated when the wipers wipe the face. Although constant-driving force control continues even in the section D in which the wipers end the wiping of the face, the setting of the driving force is changed to be a smaller value than that in the section C. This control can shorten the cleaning time in the section C.

The above-described embodiments have explained an example in which the wipers 7 and 8 are moved with respect to the stationary printhead 3. However, an arrangement in which the printhead 3 is moved with respect to the wipers 7 and 8, or an arrangement in which the printhead 3 and the wipers 7 and 8 are relatively moved may be adopted. In this case, it is configured to control the speed and driving force of each moving member when the printhead 3 and the wipers 7 and 8 are relatively moved in accordance with their relative positions. This can reduce a shock applied when a moving member such as the printhead or wiper abuts against the stopper in the cleaning operation.

Other Embodiments

Embodiments of the present invention can also be realized by a computer of a system or apparatus that reads out and executes computer executable instructions recorded on a storage medium (e.g., non-transitory computer-readable storage medium) to perform the functions of one or more of the above-described embodiment(s) of the present invention, and by a method performed by the computer of the system or apparatus by, for example, reading out and executing the computer executable instructions from the storage medium to perform the functions of one or more of the above-described embodiment(s). The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blue-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-166997, filed Aug. 9, 2013 which is hereby incorporated by reference herein in its entirety.

What is claimed is:

1. An inkjet printing apparatus comprising:

a cleaning unit configured to perform a cleaning operation of moving at least one of a printhead and a wiper, and wiping an orifice face including an orifice array of the printhead by the wiper;

a detection unit configured to detect relative positions of the printhead and the wiper during the cleaning operation; and a control unit configured to switch between first control of controlling a speed to be constant when the printhead and the wiper are moved and second control of controlling a driving force to be constant when the printhead and the wiper are moved in accordance with the relative positions detected by the detection unit.

2. The apparatus according to claim 1, wherein the cleaning unit includes a driving unit configured to reciprocate the wiper along the orifice face, and the control unit switches between the first control and the second control in accordance with a position of the wiper with respect to the printhead that is detected by the detection unit during the cleaning operation.

3. The apparatus according to claim 1, wherein the control unit performs the first control at a start of the cleaning operation by the cleaning unit, and switches to the second control before an end of the cleaning operation.

4. The apparatus according to claim 1, wherein the control unit performs the first control in a first section in which the cleaning operation starts and the wiper wipes the orifice face, and performs the second control in a second section in which the wiper ends wiping of the orifice face and a stopper restricts movement.

5. The apparatus according to claim 4, wherein the stopper is arranged at an end position of the second section.

6. The apparatus according to claim 4, wherein the stopper includes stoppers arranged at an end position of the second section and a start position of the first section.

7. The apparatus according to claim 4, wherein a wiper cleaner configured to scrape off an adherent matter of the wiper is arranged in the second section.

8. The apparatus according to claim 1, wherein the control unit performs the first control in a first section until the wiper passes an orifice range of the orifice face after the cleaning operation starts, then switches to the second control, and continues the second control in a second section until the wiper passes the orifice face.

9. The apparatus according to claim 8, wherein a driving force set in the second section is set to be a larger value than a maximum load generated when the wiper wipes the orifice face.

10. The apparatus according to claim 8, wherein the control unit continues the second control in a third section in which wiping of the orifice face by the wiper ends and a stopper restricts movement after the second section, and changes a setting of the driving force to be a smaller value than in the second section.

11. The apparatus according to claim 10, wherein the stopper is arranged at an end position of the third section.

12. The apparatus according to claim 10, wherein the stopper includes stoppers arranged at an end position of the third section and a start position of the first section.

13. The apparatus according to claim 10, wherein a wiper cleaner configured to scrape off an adherent matter of the wiper is arranged in the third section.

14. A control method of an inkjet printing apparatus having a printhead having an orifice face including an orifice array, and a wiper configured to wipe the orifice face, the method comprising:

a step of performing a cleaning operation of moving at least one of the printhead and the wiper, and wiping the orifice face by the wiper;

a step of detecting relative positions of the printhead and the wiper during the cleaning operation; and a step of switching between first control of controlling a speed to be constant when the printhead and the wiper are moved, and second control of controlling a driving force to be constant when the printhead and the wiper are moved in accordance with the detected relative positions.

* * * * *